US010827789B2

(12) United States Patent
Brensinger et al.

(10) Patent No.: US 10,827,789 B2
(45) **Date of Patent: *Nov. 10, 2020**

(54) VENTILATION AND TEMPERATURE ADJUSTMENT OPENING FOR OUTDOOR EQUIPMENT

(71) Applicant: Nemo Equipment, Inc., Dover, NH (US)

(72) Inventors: Camon Brensinger, Stratham, NH (US); Suzanne Turell, Santa Cruz, CA (US); Connie Yang, Santa Cruz, CA (US); Nathan Phipps, Watertown, MA (US)

(73) Assignee: NEMO Equipment, Inc., Dover, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/696,141

(22) Filed: Nov. 26, 2019

(65) Prior Publication Data

US 2020/0138135 A1 May 7, 2020

Related U.S. Application Data

(63) Continuation-in-part of application No. 14/284,892, filed on May 22, 2014, now Pat. No. 10,512,344.

(51) Int. Cl.

| | |
|---|---|
| ***A41D 27/28*** | (2006.01) |
| ***A47G 9/08*** | (2006.01) |
| ***A41D 1/02*** | (2006.01) |
| ***A42C 5/04*** | (2006.01) |
| *A47G 9/02* | (2006.01) |

(52) U.S. Cl.

CPC ..... *A41D 27/28* (2013.01); *A41D 1/02* (2013.01); *A42C 5/04* (2013.01); *A47G 9/086* (2013.01); *A41B 2400/20* (2013.01); *A47G 9/0215* (2013.01)

(58) Field of Classification Search

CPC . A41D 27/28; A41D 1/02; A42C 5/04; A47G 9/086; A47G 9/0215; A41B 2400/20

See application file for complete search history.

(56) References Cited

U.S. PATENT DOCUMENTS

| | | | | |
|---|---|---|---|---|
| 5,551,172 A * | 9/1996 | Yu | A43B 7/10 | 36/3 A |
| 5,881,405 A * | 3/1999 | Garrigues | A47G 9/086 | 135/117 |
| 6,216,290 B1 * | 4/2001 | Zemitis | A47G 9/086 | 112/475.08 |
| 6,263,510 B1 * | 7/2001 | Bay | A41D 27/28 | 2/108 |

(Continued)

*Primary Examiner* — Robert G Santos
*Assistant Examiner* — Rahib T Zaman
(74) *Attorney, Agent, or Firm* — Bourque & Associates

(57) ABSTRACT

An outdoor item such as a sleeping bag, jacket, hat or blanket with one or more ventilation/temperature adjustment openings. Each ventilation/temperature adjustment opening includes a fastening mechanism that when opened, an opening is formed in the outer layer and insulative material/layer of the sleeping bag but not in the inner layer, allowing the outdoor item to vent better, thereby cooling an occupant using or wearing the outdoor item thereby offering temperature regulation.

10 Claims, 3 Drawing Sheets

(56) References Cited

U.S. PATENT DOCUMENTS

| | | | | |
|---|---|---|---|---|
| 6,338,173 | B1 * | 1/2002 | Ramsey | A47G 9/086 5/41 R |
| 6,438,774 | B1 * | 8/2002 | Michaelis | A47G 9/086 2/69.5 |
| 6,449,787 | B1 * | 9/2002 | Thorne | A47G 9/086 2/69.5 |
| 6,510,593 | B1 * | 1/2003 | Kim | A44B 19/301 24/382 |
| 6,792,621 | B2 * | 9/2004 | Braun | A41D 27/285 2/1 |
| D569,159 | S * | 5/2008 | Walker | D6/595 |
| 7,752,690 | B1 * | 7/2010 | Seth | A47G 9/086 2/69.5 |
| 8,499,381 | B1 * | 8/2013 | Miller | A47G 9/086 2/69.5 |
| 10,512,344 | B2 * | 12/2019 | Brensinger | A47G 9/086 |
| 2005/0034234 | A1 * | 2/2005 | Bellick | A47G 9/086 5/413 R |
| 2009/0271909 | A1 * | 11/2009 | Hegland | A45F 4/12 2/69.5 |
| 2010/0192298 | A1 * | 8/2010 | Michaelis | A47G 9/086 5/413 R |

* cited by examiner

VENTILATION AND TEMPERATURE ADJUSTMENT OPENING FOR OUTDOOR EQUIPMENT

CROSS-REFERENCE TO RELATED APPLICATIONS

This application in a continuation-in-part of U.S. patent application Ser. No. 14/284,892 entitled VENTILATION AND TEMPERATURE ADJUSTMENT OPENING FOR SLEEPING BAGS filed on May 22, 2014 which claims priority from U.S. Provisional Patent Application No. 61/806,108, titled "Outdoor Products", which was filed on Mar. 28, 2013 and both of which are incorporated fully herein by reference.

TECHNICAL FIELD

The present invention relates to outdoor equipment and products and more particularly, relates to outdoor equipment used for covering and providing warmth to a user such as sleeping bags, clothing and blankets having adjustable ventilation/temperature control openings.

BACKGROUND INFORMATION

Sleeping bags, clothing and outdoor blankets are typically rated by their ability to handle certain temperature extremes. For example, a sleeping bag may be rated to −10° F. or −30° F. When using a sleeping bag that is rated for a cooler environment, the sleeping bag can be too warm when used in a warmer environment. The same is true of clothing and blankets for outdoor use for example. The typical solution is for a user to have multiple sleeping bags or jackets or other clothing items and blankets rated for different temperatures. This is expensive and sometimes may still leave the user with a sleeping bag that is too warm for the encountered weather when temperature conditions which may not be as cold as expected. The same problem exists in other outdoor items such as jackets, blankets and even hats.

Therefore, in order to be able to adjust to ever-changing temperatures, what is needed is outdoor equipment that offers temperature regulation through increased breathability and the ability to allow an occupant to "cool down" without requiring the occupant to fully open the outdoor equipment.

SUMMARY OF THE INVENTION

The invention features a piece of outdoor covering such as a sleeping bag, jacket, blanket, hat or the like having one or more ventilation or temperature adjustment openings. A sleeping bag comprises an upper region, configured for containing a head, shoulder and upper body portion of a user, a lower region configured for containing a lower body portion including feet and legs of the user, and a middle region located between the upper and lower regions. Each of the upper, lower and middle regions constructed of a top layer of material, a bottom layer of material and an insulative material disposed between the top and bottom layers.

At least one ventilation/temperature adjustment opening is disposed in one of the sleeping bag upper, middle or lower regions. The at least one ventilation/temperature adjustment opening is formed by providing an opening in the top layer of material and in the insulative material disposed beneath the opening in the top layer of material. The opening in the insulative material is defined by a first and a second inner wall of the ventilation/temperature adjustment opening, the first and second inner walls formed by an inner wall material layer, each inner wall material layer including a portion attached to the sleeping bag top layer and a portion attached to the sleeping bag bottom layer.

The at least one ventilation/temperature adjustment opening includes a fastening mechanism coupled to the sleeping bag top layer of material. The fastening mechanism includes a first fastener element disposed on a first side of the ventilation/temperature adjustment opening and a second fastener element disposed on a second side of the ventilation/temperature adjustment opening. The fastening mechanism is configured for opening and closing the at least one ventilation/temperature adjustment opening.

In one embodiment, the ventilation/temperature adjustment opening is located in the middle region of the sleeping bag. The ventilation/temperature adjustment opening begins in the lower region of the sleeping bag and extends to the upper region.

In one or more embodiments, the insulative material may be selected from the group consisting of down fill, polyester fill, natural insulative material and synthetic insulative material while the fastening mechanism may be selected from the group consisting of a zipper, a plurality of hook and loop fasteners, a plurality of buttons and button holes and a plurality of snap fasteners.

The sleeping bag according to the first embodiment of the present invention may include two of the ventilation/temperature adjustment openings.

In another embodiment, the present invention features and outdoor item in the form of a covering configured to provide warmth to a user. An example of such a covering includes a jacket, blanket and/or hat for example. Much like the sleeping bag described herein, the covering is constructed of an outer layer of non-insulative material, an inner layer of non-insulative material and an insulative material layer disposed between the outer and inner layers.

The invention is not intended to be limited to a device or method which must satisfy one or more of any stated or implied objects or features of the invention and should not be limited to the preferred, exemplary, or primary embodiment(s) described herein. Modifications and substitutions by one of ordinary skill in the art are considered to be within the scope of the present invention.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1A:
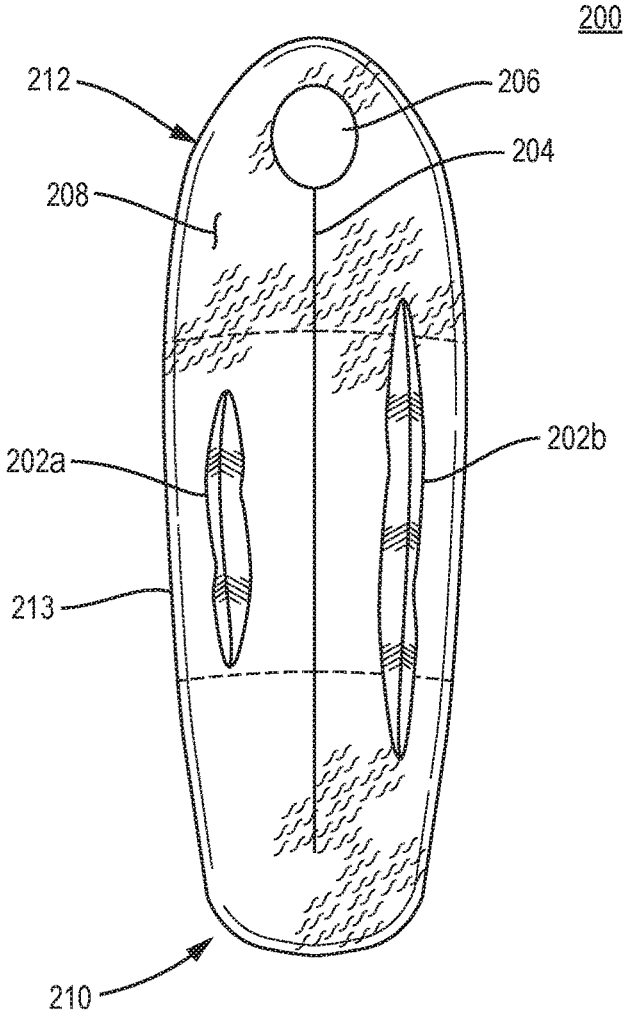
FIG. 1A is a detailed view of the location of the thermo-gills according to one embodiment of the present invention.

The present invention features one or more ventilation/temperature adjustment openings or "thermo gills" for a piece of outdoor equipment used for covering and providing warmth to a user such as a sleeping bag, jacket or blanket. In a first embodiment of the present invention, first and second thermo-gills or temperature/venting elements 202 are used on a sleeping bag 200, FIGS. 1A and 1B.

In this first embodiment, the sleeping bag 200, which can be any type of sleeping bag, features a length and width, and includes two ventilation or temperature adjustment openings 202*a* and 202*b*, which extend along a length of the front or side of the sleeping bag 200. A first ventilation or temperature adjustment opening 202*a* is located on a first side of a central access opening 204 and a second ventilation or temperature adjustment opening 202*b* is located on a second side of the central access opening 204. The central access opening 204 is typically a zipper which is utilized to allow the user to enter and exit the sleeping bag 200. Once the user is inside, the zipper is pulled up proximate the head or shoulder region 206 of the user now located inside the sleeping bag as is well known in the art.

Figure 1B:
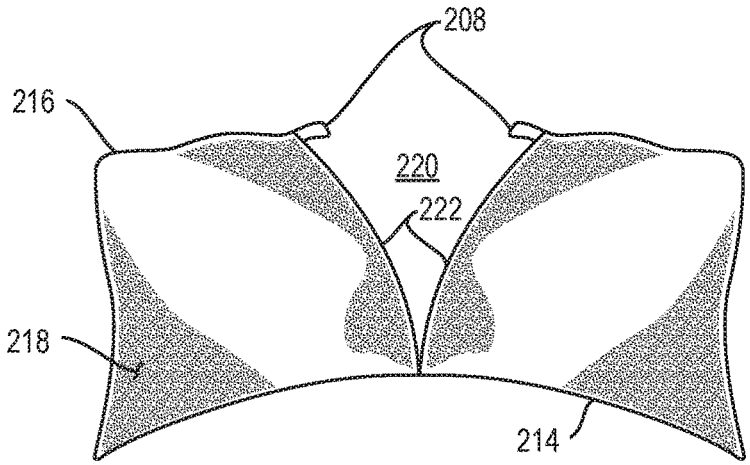
FIG. 1B is a cross-sectional view of the ventilation or temperature adjustment openings for a sleeping bag in an open position according to one embodiment of the present invention.

Each ventilation or temperature adjustment opening 202 is formed by a two part traditional zipper 208, FIG. 1B, or similar and equivalent closure or fastener mechanism sewed or otherwise adhered to a region proximate the outer layer 216 of the sleeping bag 200 such as a hook and loop closure, a plurality of buttons, and a plurality of snaps. The length of the ventilation or temperature adjustment openings 202 may vary without the departing from the scope and intent of the present invention. For example, the ventilation or temperature adjustment opening 200 may begin near the foot box portion 210 of the sleeping bag 200 and extend anywhere up to and including the shoulder region 212 of the sleeping bag 200. Alternatively, as shown in the drawing, the ventilation or temperature adjustment openings 200 may be located generally in the central or middle region 213 of the sleeping bag which would be in the area of the midsection of the user (not shown) when located inside the sleeping bag.

As shown in FIG. 1B, the sleeping bag consists of an inner material 214 such as 20 denier durable, water repellent nylon which is designed to rest closest to the user; and an outer layer 216 such as 15 denier ripstop, polyurethane coated, water proof and breathable nylon exposed to the air and elements. In one embodiment, the inner material 214 may be different in different parts of the sleeping bag. For example, the foot box portion or lower region 210 of the sleeping bag may have a different inner material such as 33 to 44 denier ripstop nylon that is durable water repellent treated and having a Cire finish that increases shininess.

Between the inner layer 214 and the outer layer 216 is the insulative material 218 which may include but is not limited to down fill; polyester fill or any other type of natural or synthetic insulative material which may be utilized in the construction of a sleeping bag 200 and which gives the sleeping bag its warmth.

When the zipper or other fastening mechanism 208 of the ventilation or temperature adjustment opening 202 is opened, a crevice or generally "V" shaped opening 220 is formed in the outer layer 216 and the insulative material 218, allowing the sleeping bag to breathe better, thereby cooling an occupant of the sleeping bag and offering temperature regulation. The inner walls 222 of the opening 220 may be formed from the same material as the outer layer 216; the same material as the inner layer 214; or a completely different material, all as selected by the manufacturer of the sleeping bag. The inner layer 214 remains intact to prevent the sleeping bag 200 from dividing into two (2) sections and/or to prevent insects and the like from entering the sleeping bag, garment, blanket or other covering provided with one or more ventilation openings.

The amount of ventilation provided to the user may be adjusted and selected by the user by simply opening or closing more or less of the zipper or other fastener 208, which adjusts the length of the ventilation or temperature adjustment openings 202. In this way, a very insulative sleeping bag designed for cold or very cold weather may be utilized in moderately cold weather without causing the user to overheat in the sleeping bag by simply adjusting the ventilation or temperature control openings 202, thereby eliminating the need for a user to try to accurately predict the temperature where he or she is going and predict which sleeping bag should be used and instead, simply regulate the warmth afforded by the sleeping bag utilizing the temperature or ventilation openings 202 of the present invention to instead regulate the temperature inside the bag. The same holds true for other outdoor coverings such as jackets, blankets and potentially even hats and the like.

Figure 2:
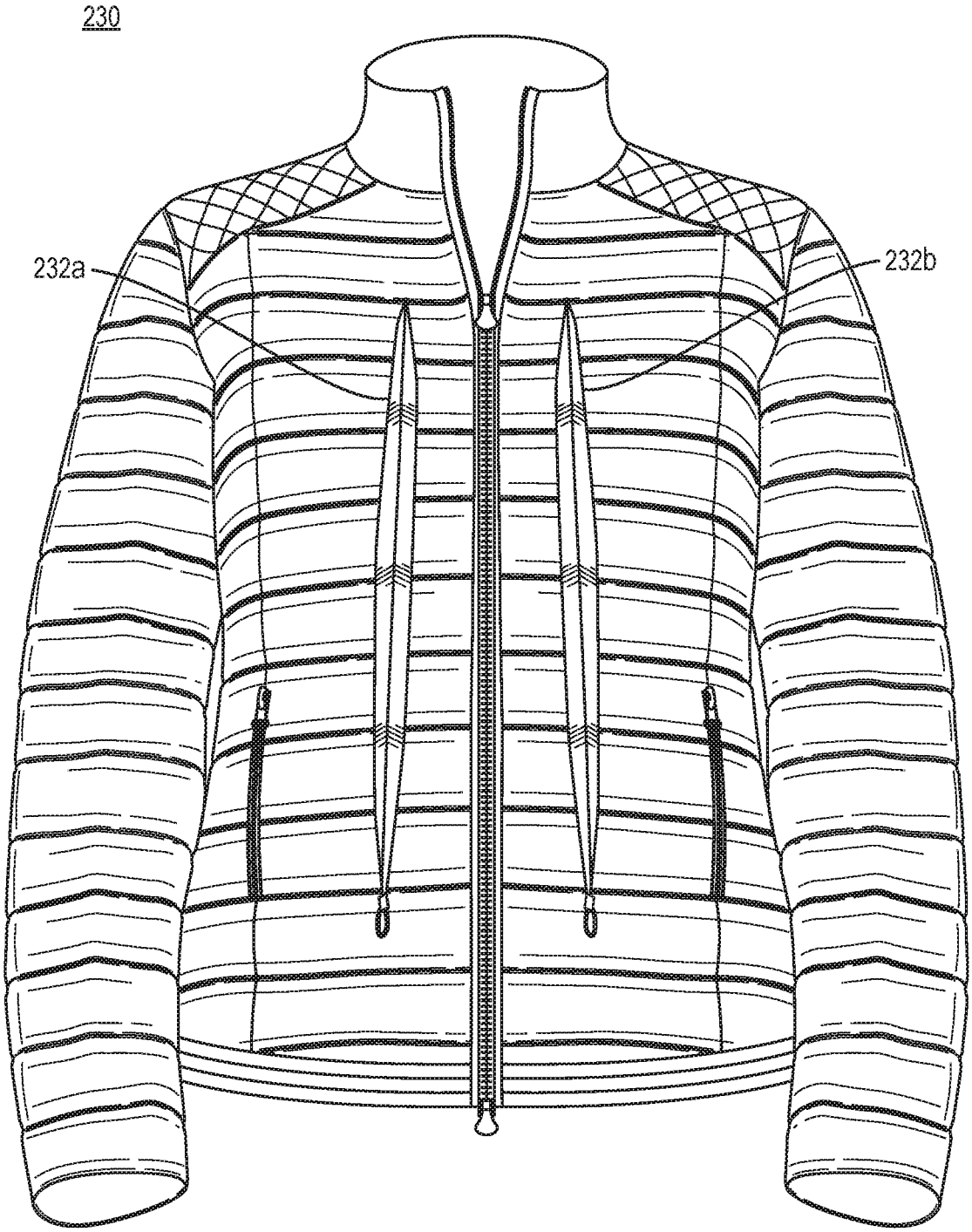
FIG. 2 is a front prospective you of the ventilation or temperature adjustment openings for outdoor equipment shown in and open position in an outdoor jacket according to one feature of the present invention.
Figure 3:
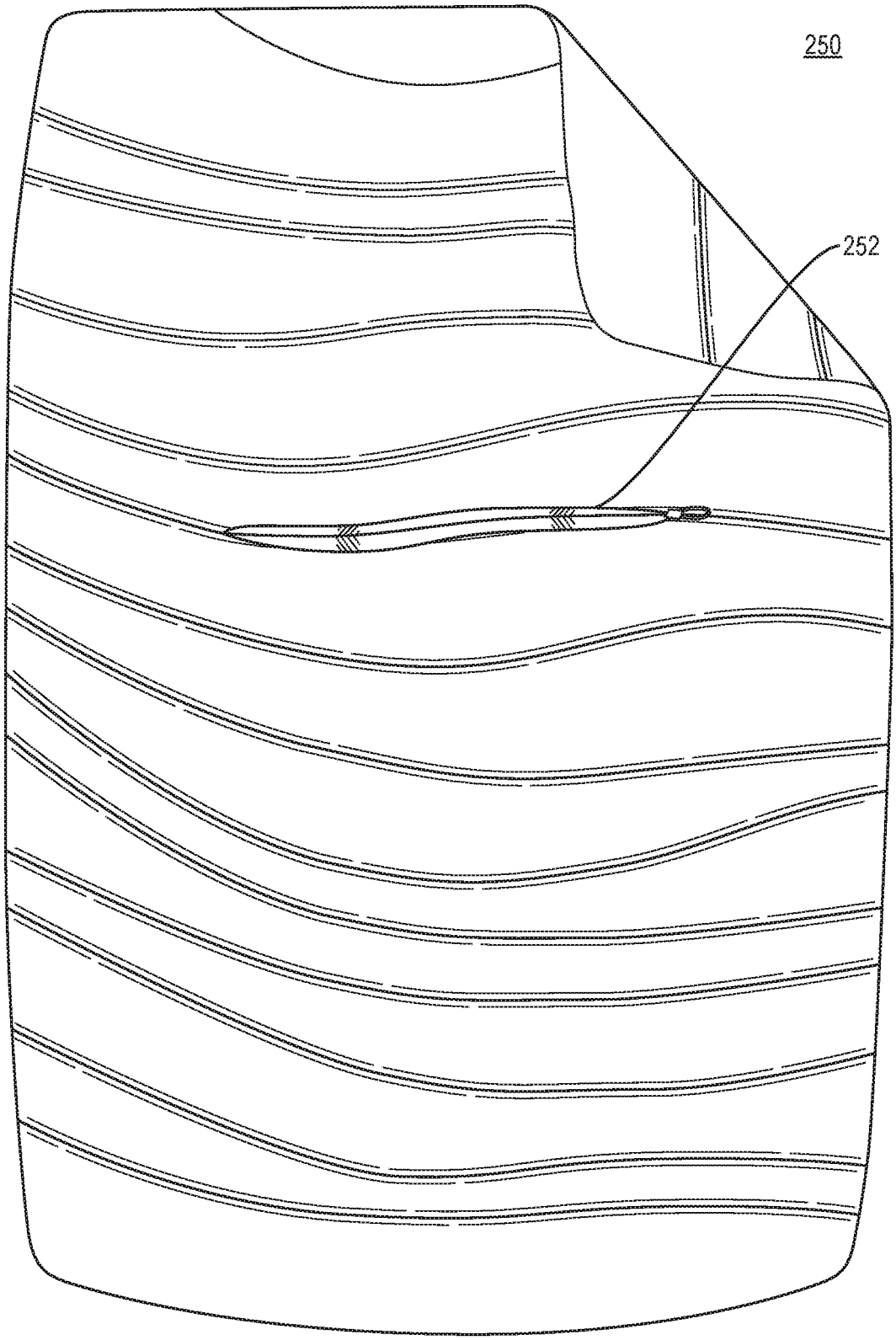
FIG. 3 is a cross-sectional view of the ventilation or temperature adjustment opening for outdoor equipment shown in and open position in a blanket according to another feature of the present invention.

The present invention is not limited to providing ventilation or temperature regulating openings in a sleeping bag but may also be utilized in other outdoor equipment such as a jacket or coat 230, FIG. 2 or a blanket, FIG. 3. In much the same way as described in connection with the embodiment covering sleeping bags, the ventilation or temperature regulating openings 232 may be provided and opened or closed to a desired extent by the user to regulate the ventilating action of the openings 232. The ventilation or temperature regulating openings 232 may be located not only in the front of the garment but also in the sleeve (not shown) and also potentially in the back of the garment (also not shown) which other locations are considered to be within the scope of the present disclosure.

In another embodiment, one or more ventilation or temperature regulating openings 252, FIG. 3 may be provided in a blanket 250. Again, although only one opening is shown is considered to be within the scope of the present invention that multiple openings may be provided in multiple regions of the blanket 250.

As stated above, the present invention is not intended to be limited to a device or method which must satisfy one or more of any stated or implied objects or features of the invention and should not be limited to the preferred, exemplary, or primary embodiment(s) described herein. Modifications and substitutions by one of ordinary skill in the art are considered to be within the scope of the present invention, which is not to be limited except by the allowed claims and their legal equivalents.

The invention claimed is:

1. A covering including one or more temperature adjustment openings for providing warmth to a user, said covering comprising: a covering configured to provide warmth to a user, said covering constructed of an outer layer of non-insulative material, an inner layer of non-insulative material and an insulative material layer disposed between the outer and inner layers; and at least one temperature adjustment opening disposed in said outer layer of non-insulative material, the at least one temperature adjustment opening formed by an opening in only the outer layer of non-insulative material and in the insulative material layer disposed beneath the at least one temperature adjustment opening in the outer layer of non-insulative material and not in said inner layer of non-insulative material such that said at least one temperature adjustment opening is configured for not expanding an interior volume of said covering, the opening in the insulative material layer defined by first and a second inner walls of the temperature adjustment opening, the first and second inner walls formed in said insulative material layer by first and second inner wall material layers, each of said first and second inner wall material layers including a portion attached to the outer layer and a portion attached to the inner layer forming first and second sides of each of said at least one temperature adjustment opening, the at least one temperature adjustment opening including a fastening mechanism coupled to the outer layer of non-insulative material, the fastening mechanism including a first fastener element portion disposed on a first side of the at least one temperature adjustment opening and a second fastener element portion disposed on a second side of the at least one temperature adjustment opening, the fastening mechanism configured for allowing the at least one temperature adjustment opening to be configured in one of at least a partially open and at least a partially closed position, wherein in said at least a partially open position, said at least one temperature adjustment opening does not include any insulative material between said non-insulative inner layer portion and said at least one temperature adjustment opening.

2. The covering of claim 1, wherein the covering is a sleeping bag.

3. The covering of claim 2, wherein the at least one temperature adjustment opening is located in a middle region of the sleeping bag.

4. The covering of claim 2, wherein the at least one temperature adjustment opening begins in a lower region of the sleeping bag and extends to proximate an upper region.

5. The covering of claim 1, wherein the insulative material is selected from the group of insulative materials consisting of down fill, polyester fill, natural insulative material and synthetic insulative material.

6. The covering of claim 1, wherein the fastening mechanism is selected from the group of fastening mechanisms consisting of a zipper, one or more hook and loop fasteners, a plurality of buttons and corresponding button holes and a plurality of snap fasteners.

7. The covering of claim 1, wherein the covering includes two temperature adjustment openings.

8. The covering of claim 1, wherein said covering includes a jacket.

9. The covering of claim 1, wherein said covering includes a blanket.

10. The covering of claim 1, wherein said covering includes a hat.

* * * * *